US010912437B2

(12) United States Patent
Lee et al.

(10) Patent No.: US 10,912,437 B2
(45) Date of Patent: Feb. 9, 2021

(54) VACUUM CLEANER AND CLEANER HANDLE

(71) Applicant: LG Electronics Inc., Seoul (KR)

(72) Inventors: Jinwoo Lee, Seoul (KR); Gunho Ha, Seoul (KR); Hwajin Lim, Seoul (KR); Hyeonjeong An, Seoul (KR); Bohyun Nam, Seoul (KR); Namhee Kim, Seoul (KR); Sehwan Bae, Seoul (KR)

(73) Assignee: LG Electronics Inc., Seoul (KR)

( * ) Notice: Subject to any disclaimer, the term of this patent is extended or adjusted under 35 U.S.C. 154(b) by 95 days.

(21) Appl. No.: 16/063,610

(22) PCT Filed: Dec. 21, 2016

(86) PCT No.: PCT/KR2016/015063
§ 371 (c)(1),
(2) Date: Jun. 18, 2018

(87) PCT Pub. No.: WO2017/116067
PCT Pub. Date: Jul. 6, 2017

(65) Prior Publication Data

US 2018/0368643 A1 Dec. 27, 2018

(30) Foreign Application Priority Data

Dec. 30, 2015 (KR) ..... 10-2015-0189468
Dec. 30, 2015 (KR) ..... 10-2015-0189542

(51) Int. Cl.
*A47L 9/32* (2006.01)
*A47L 9/24* (2006.01)

(52) U.S. Cl.
CPC ..... *A47L 9/327* (2013.01); *A47L 9/248* (2013.01)

(58) Field of Classification Search
CPC ..... A47L 9/248; A47L 9/327
See application file for complete search history.

(56) References Cited

FOREIGN PATENT DOCUMENTS

| | | |
|---|---|---|
| CN | 1293942 | 5/2001 |
| CN | 101396249 | 4/2009 |
| CN | 102334956 | 2/2012 |
| CN | 202601108 | 12/2012 |
| CN | 204218837 | 3/2015 |
| CN | 202981885 | 6/2016 |
| DE | 10-2004-026768 A | 12/2004 |

(Continued)

OTHER PUBLICATIONS

KR 101322574 B1—English Machine Translation (Year: 2013).*

(Continued)

*Primary Examiner* — Marc Carlson
(74) *Attorney, Agent, or Firm* — Fish & Richardson P.C.

(57) ABSTRACT

A handle for a cleaner according to the present disclosure includes: an extension tube connector that is connected to an extension tube; an air flow pipe that communicates with the extension tube connector to transfer air and dusts that is received from the extension tube connector; a grip part that is to be held by a user; and a grip part connector that connects the extension tube connector and the grip part to each other and is rotated with respect to the air flow pipe, wherein the grip part is rotated together with the grip part connector and the extension tube connector, and the grip part is rotated with respect to the central line of the extension tube connector.

15 Claims, 10 Drawing Sheets

(56) References Cited

FOREIGN PATENT DOCUMENTS

| | | | | | |
|---|---|---|---|---|---|
| DE | 102004026768 | A1 | * | 12/2004 | ..... A47L 9/1691 |
| EP | 2805661 | A | | 11/2014 | |
| EP | 2805661 | A1 | * | 11/2014 | ..... A47L 9/0653 |
| JP | 05161580 | A | * | 6/1993 | |
| JP | H05-161580 | A | | 6/1993 | |
| JP | 2000-014612 | A | | 1/2000 | |
| JP | 2000014612 | A | * | 1/2000 | |
| JP | 3151746 | B | | 4/2001 | |
| JP | 2004261587 | A | | 9/2004 | |
| JP | 4284160 | | | 6/2009 | |
| JP | 2009-279230 | A | | 12/2009 | |
| JP | 2009279230 | A | * | 12/2009 | |
| JP | 2013-059525 | A | | 4/2013 | |
| JP | 2013059525 | A | * | 4/2013 | |
| KR | 500844 | A | | 7/2005 | |
| KR | 471739 | A | | 8/2005 | |
| KR | 10-1322574 | B | | 10/2013 | |
| KR | 1322574 | A | | 10/2013 | |
| KR | 101322574 | B1 | * | 10/2013 | |

OTHER PUBLICATIONS

Examination Report in Australian Application No. 2016382259, dated Aug. 13, 2018, 3 pages.
Supplementary European Search Report in European Application No. 16882019.9, dated Oct. 5, 2018, 9 pages.
Chinese Office Action in Chinese Appln. No. 201680077126.6, dated Dec. 17, 2020, 7 pages (with English translation).

* cited by examiner

VACUUM CLEANER AND CLEANER HANDLE

CROSS-REFERENCE TO RELATED APPLICATIONS

This application is a National Stage application under 35 U.S.C. § 371 of International Application No. PCT/KR2016/015063, filed on Dec. 21, 2016, which claims the benefit of Korean Application No. 10-2015-0189468, filed on Dec. 30, 2015 and Korean Application No. 10-2015-0189542, filed on Dec. 30, 2015. The disclosures of the prior applications are incorporated by reference in their entirety.

TECHNICAL FIELD

The present disclosure relates to a vacuum cleaner and a handle for a cleaner.

BACKGROUND

In general, a vacuum cleaner refers to an apparatus for sucking dusts and foreign substances on a surface to be cleaned using a suction motor that is provided inside a body and then filtering the dusts and the foreign substances within the body.

The above-described vacuum cleaner may be classified into an upright vacuum cleaner in which a suction nozzle is connected to a body and is moved together with the body and a canister vacuum cleaner in which a suction nozzle is connected to a body through an extension tube, a handle, a hose and the like.

U.S. Pat. No. 8,671,517 (filed on Mar. 18, 2014) as the prior art discloses a handle for an extension tube of a vacuum cleaner.

The handle disclosed in the prior art includes a handle body, a handle cover that defines a handle grip part together with the handle body and a cylindrical rotation part. The handle grip part is arranged between a front tube and a rear tube. Here, the rotation part may be connected to the front tube and the rear tube, and the handle grip part is located outside the rotation part to connect the front tube and the rear tube to each other. The extension tube may be connected to the front tube.

A user may hold the handle grip part. Further, when the user rotates the handle grip part leftward or rightward while holding the handle grip part, a rotational force by which the user rotates the handle grip part is transferred to the front tube and the rear tube, so that the extension tube that is provided in the front tube is rotated with respect to the rotation part.

However, in the case of the handle according to the prior art, a center of the front tube does not pass through the handle grip part.

Thus, when the user rotates the handle grip part while holding the handle grip part, a rotational path of the handle grip part is lengthened, and thus, a large force is required such that the user rotates the handle grip part.

Further, because the center of the front tube does not pass through the handle grip part, the rotational path of the handle grip part is lengthened when the user rotates the handle grip part while holding the handle grip part. Thus, a wrist of the user is largely bent, and thus a burden is applied to the wrist.

Further, because the center of the front tube does not pass through the handle grip part, the wrist of the user is bent even when the user moves a bottom tool that is connected to the handle forward or rearward while holding the handle grip part.

Thus, a burden is applied to the wrist.

DISCLOSURE OF THE INVENTION

Technical Problem

An aspect of the present disclosure is to provide a vacuum cleaner and a handle for the cleaner, in which a wrist is prevented from being bent when a user moves a suction part forward or rearward while holding a grip part.

Further, another aspect of the present disclosure is to provide a vacuum cleaner and a handle for the cleaner in which a hand of a user is prevented from missing a grip part when the user pushes or pulls the grip part while holding the grip part.

Further, another aspect of the present disclosure is to provide a vacuum cleaner and a handle for the cleaner, in which ease of cleaning for a user is improved as an extension tube is rotated together through rotation of a grip part.

Further, another aspect of the present disclosure is to provide a vacuum cleaner and a handle for the cleaner in which a handle may be rotated with a small force in a state in which a user holds a grip part.

Further, another aspect of the present disclosure is to provide a vacuum cleaner and a handle for the cleaner in which a wrist of a user is minimally bent during a process of rotating a grip part.

Technical Solution

A handle for a cleaner according to an aspect may include: an extension tube connector that is connected to an extension tube; an air flow pipe that communicates with the extension tube connector to transfer air and dusts that is received from the extension tube connector; a grip part that is to be held by a user; and a grip part connector that connects the extension tube connector and the grip part to each other and is rotated with respect to the air flow pipe, wherein the grip part and the grip part connector may be arranged such that a central line C of the extension tube connector passes through the grip part, the grip part may be rotated together with the grip part connector and the extension tube connector, and the grip part may be rotated with respect to the central line C of the extension tube connector.

The air flow pipe may include a pipe body that defines an air passage, and a rotation guide that extends from the pipe body and guides rotation of the extension tube connector. The central line C of the extension tube connector may pass through the rotation guide.

An extension direction of a portion of the pipe body may intersect an extension direction of the rotation guide.

The extension tube connector may include a first connector that extends in parallel to the central line C of the extension tube connector, and the grip part connector may include a second connector that is fastened to the first connector.

The central line C of the extension tube connector may pass through the second connector.

The first connector may include a first fastening part that surrounds the rotation guide, and the second connector may include a second fastening part which is fastened to the first fastening part and in which a portion of the rotation guide is accommodated.

The handle may further include: an anti-separation part that prevents the rotation guide and the second fastening part from being separated from each other, and a fastening member that fastens the anti-separation part and the rotation guide to each other.

The grip part connector may further include a third connector that connects the second connector and the grip part to each other. The grip part may be located on a rear side of the second connector, and a space which is spaced apart from the grip part and in which a hand of the user is located may be formed between the grip part and the second connector.

At least a portion of the second connector may extend in a parallel direction to an extension direction of a portion of the pipe body, and at least a portion of the third connector may extend in a parallel direction to an extension direction of the central line C of the extension tube connector.

The grip part may include a manipulation part for manipulation of the user, and the central line C may be located between the manipulation part and the third connector.

The second connector, the third connector, and the grip part are arranged to have a "U" shape The handle may further include a pipe cover that covers the air flow pipe, wherein the first connector may be located inside the pipe cover.

The first connector may be formed to have an arc shape having the central line C of the extension tube connector as a center, and a portion of the pipe cover may be formed to have an arc shape having the central line C of the extension tube connector as a center. The portion of the pipe cover may have a radius that is larger than a radius of the first connector.

The grip part may include a first grip body that is rounded to be adjacent to the first connector, and a second grip body that is rounded in a curvature that is different from that of the first grip body.

A radius of the first grip body may be larger than a radius of the second grip body.

A radius of a curvature of the first grip body may be larger than a radius of a curvature of the second grip body.

A tangent line of the first grip body may be perpendicular to a tangent line of the second grip body.

A vacuum cleaner according to another aspect may include a suction part, an extension tube that is connected to the suction part, a cleaner body that communicates with the suction part and has a suction motor formed therein, a suction hose that is connected to the cleaner body, and a handle that connects the extension tube and the suction hose to each other, wherein the handle may include an extension tube connector that is connected to the extension tube, an air flow pipe that communicates with the extension tube connector and transfers air and dusts that are received from the extension tube connector, to the suction hose, a grip part that is to be held by a user, and a grip part connector that connects the extension tube connector and the grip part to each other and is rotated with respect to the air flow pipe. A center of rotation of the grip part coincides with a central line of the extension tube connector.

Advantage of the Invention

According to the proposed invention, a user may rotate a grip part while gripping the grip part, so that ease of cleaning is improved.

Also, as a central line of the extension tube connector passes through the grip part, a rotational path of the grip part is shortened, so that a force required for rotating the grip part is reduced.

Also, as the central line of the extension tube connector passes through a hand and a wrist of the user in a state in which the hand of the user grips the grip part, the grip part may be rotated by rotating the wrist about the central line of the extension tube connector in a state in which the wrist is not bent, and a rotational force of the grip part may be transmitted to the extension tube connector. Thus, the grip part may be rotated without a burden of the wrist of the user.

Also, according to the present disclosure, as the central line of the extension tube connector passes through the wrist of the user, an extension direction of the central line of the extension tube connector may be substantially parallel to an extension direction of an arm of the user in a state in which the arm of the user is stretched. Thus, in this state, a force of the user, which is required when the user pushes or pulls a handle, is minimized.

Also, a grip part connector supports the hand in a state in which the grip part is gripped by the hand of the user, so that the hand may be prevented from missing the grip part while pulling the grip part.

Also, the grip part includes a plurality of grip bodies having different radii and/or different radii of curvatures, so that the hand may be effectively prevented from missing the grip part.

BRIEF DESCRIPTION OF THE DRAWINGS

FIG. 9 illustrates a state in which a relative location between an extension tube and a cleaner body is fixed to each other for storing a vacuum cleaner, and FIG. 10 illustrates a state in which the extension tube and the cleaner body is unfixed.

DETAILED DESCRIPTION OF THE EMBODIMENTS

Figure 1:
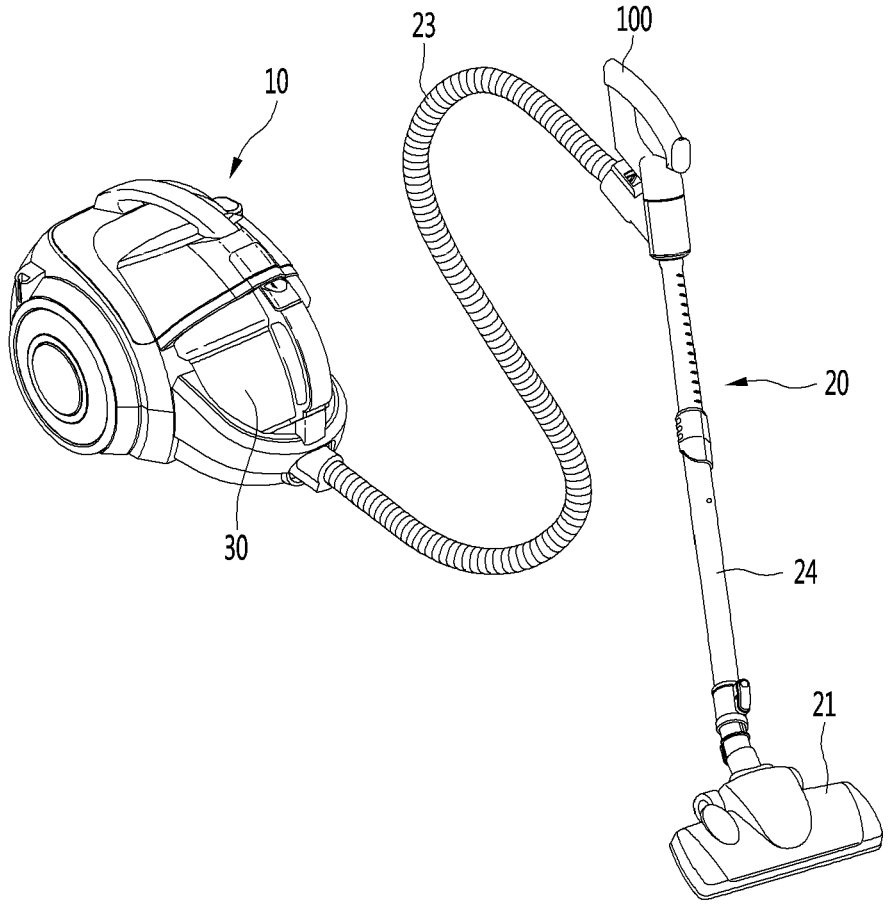
FIG. 1 is a perspective view illustrating a vacuum cleaner according to an embodiment of the present disclosure.

FIG. 1 is a perspective view illustrating a vacuum cleaner according to a first embodiment of the present disclosure.

Referring to FIG. 1, a vacuum cleaner 1 according to a first embodiment of the present disclosure may include a cleaner body 10 and a suction device 20 that is connected to the cleaner body 10.

The cleaner body 10 may include a suction motor (not illustrated) for generating a suction force.

The suction device 20 may include a suction part 21 for sucking dusts on a surface to be cleaned, for example, a bottom surface, and connection parts 100, 23 and 24 for connecting the suction part 21 to the cleaner body 10.

The connection parts 100, 23 and 24 may include an extension tube 24 that is connected to the suction part 21, a handle 100 that is connected to the extension tube 24 and a suction hose 23 that connects the handle 100 to the body 10.

When a user moves or rotates the handle 100 in a front-rear direction or a left-right direction while holding the handle 100, a moving force of the handle 100 is transferred to the suction part 21 so that cleaning is performed while the suction part 21 may be moved with respect to the bottom surface.

Further, the vacuum cleaner 1 may further include a dust separating part (not illustrated) that separates air and dusts that are sucked through the suction device 20 from each other and a dust container 30 that stores the dusts that have been separated through the dust separating part. The dust container 30 may be separably mounted on the cleaner body 10. The dust separating part may be manufactured as a product that is separate from the dust container 30 or may constitute one module with the dust container 30.

Figure 2:
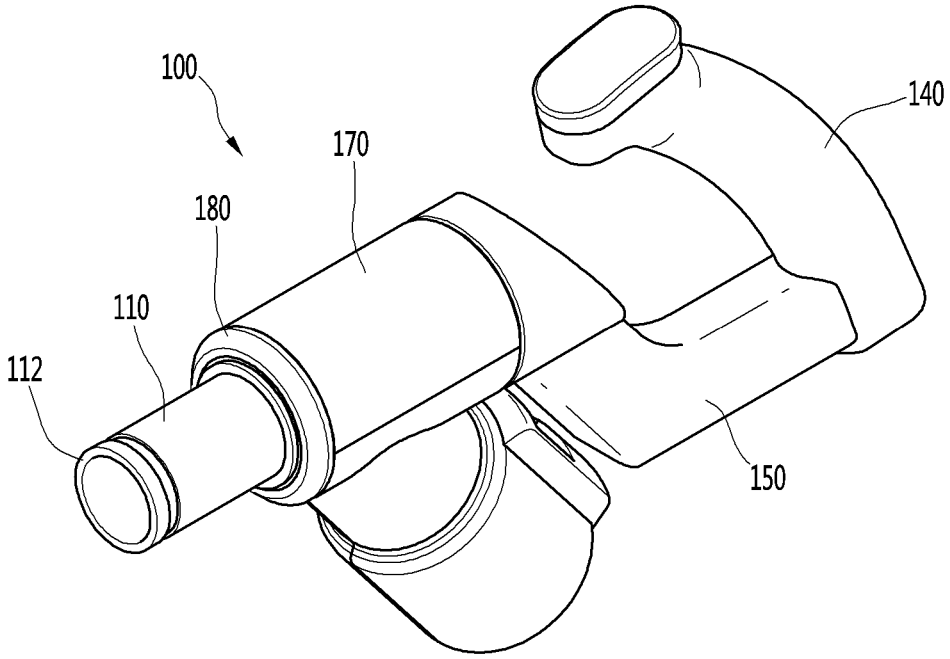
FIG. 2 is a perspective view illustrating a handle according to the embodiment of the present disclosure.
Figure 3:
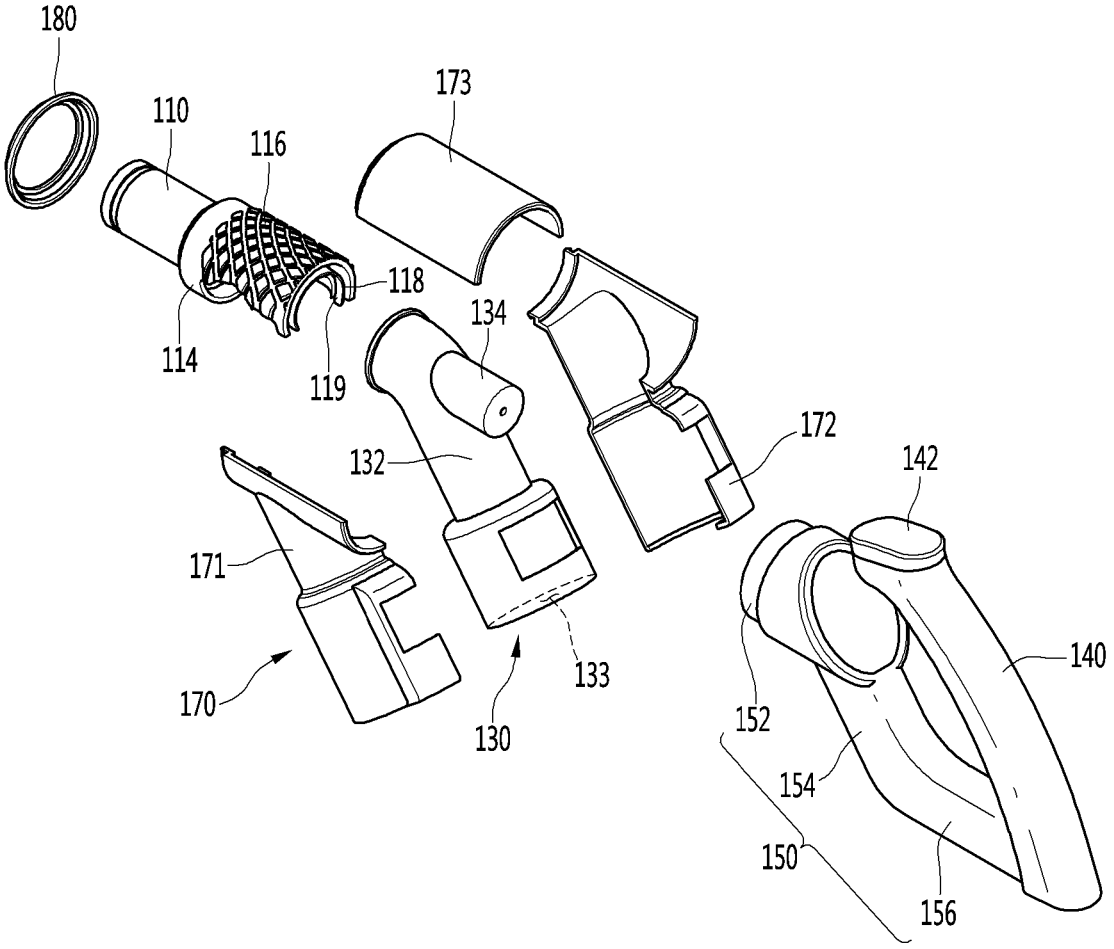
FIG. 3 is an exploded perspective view illustrating the handle of FIG. 2.
Figure 4:
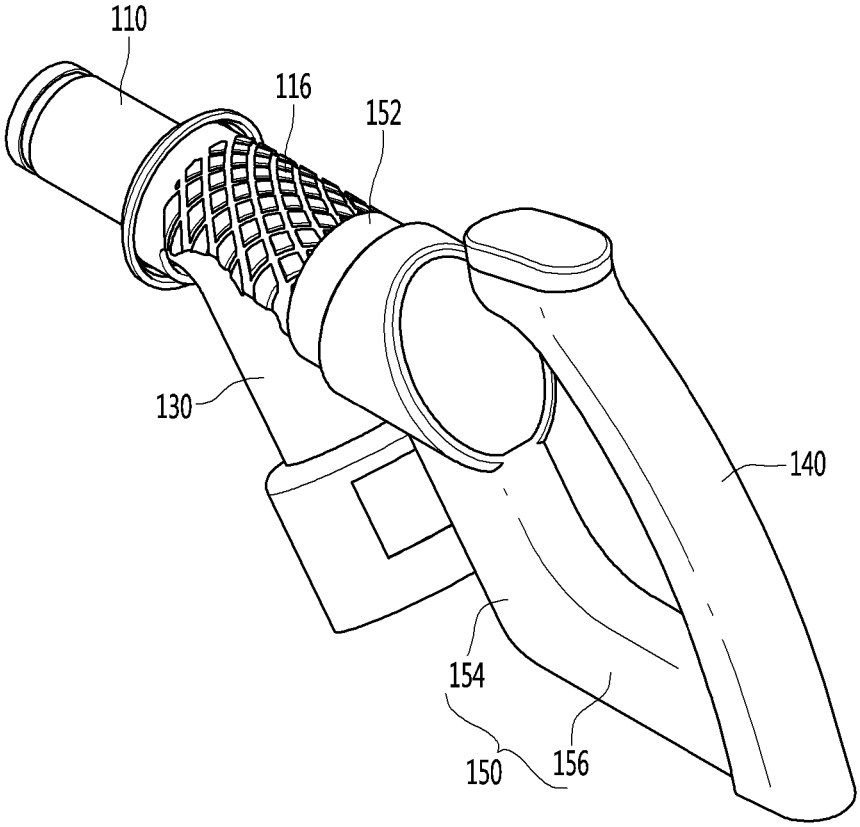
FIG. 4 is a view illustrating a state in which a pipe cover is removed from the handle of FIG. 2.
Figure 5:
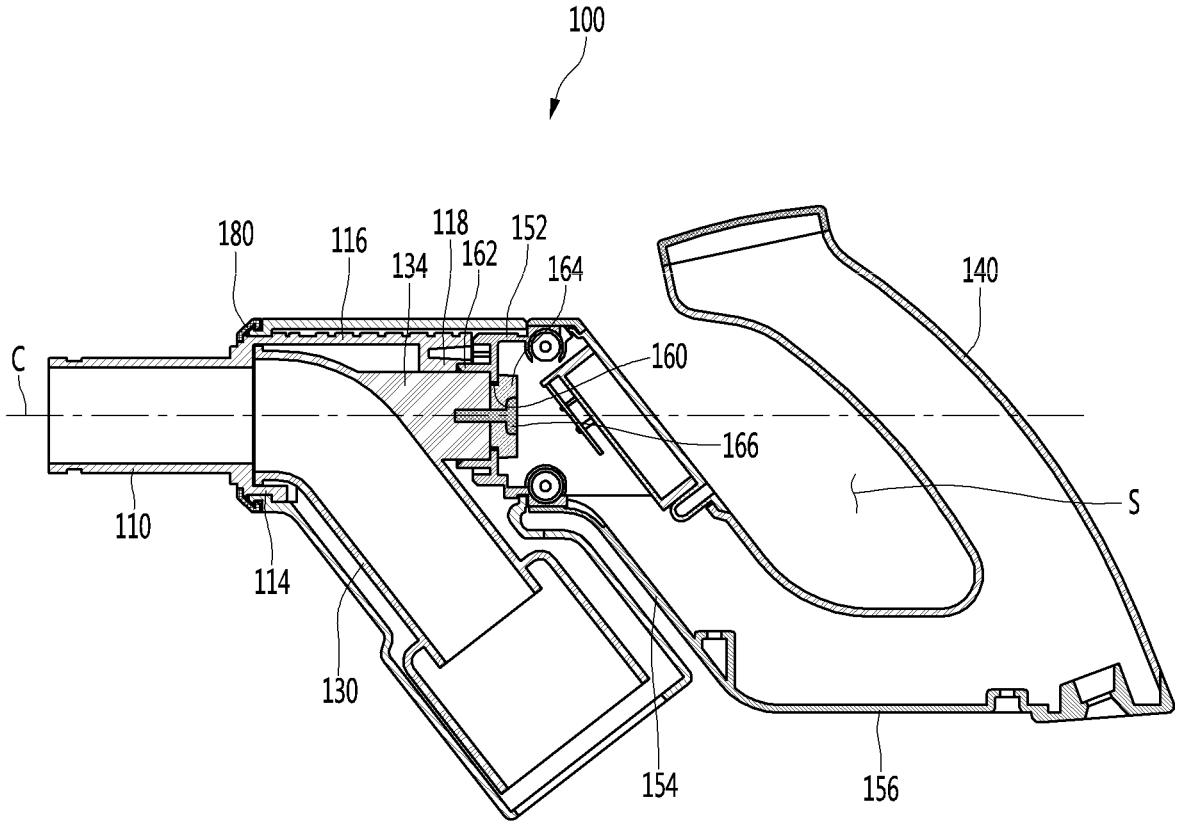
FIG. 5 is a sectional view illustrating the handle of FIG. 2.

FIG. 2 is a perspective view illustrating the handle according to the embodiment of the present disclosure, FIG. 3 is an exploded perspective view illustrating the handle of FIG. 2, FIG. 4 is a view illustrating a state in which a pipe cover is removed from the handle of FIG. 2, and FIG. 5 is a sectional view illustrating a handle body of FIG. 2.

Referring to FIGS. 2 to 5, the handle 100 according to the embodiment of the present disclosure may include an extension tube connector 110 that is connected to the extension tube 24, an air flow pipe 130 through which the air and the dusts that are introduced from the extension tube 24 flow, a grip part 140 that is to be held by the user, and a grip part connector 150 that connects the grip part 140 to the extension tube connector 110.

The extension tube connector 110 may include an air inlet 112. The extension tube 24 may be connected to the air inlet 112.

The extension tube connector 110 may further include a pipe connector 114 to which the air flow pipe 130 is connected.

The air flow pipe 130 may be rotatably connected to the pipe connector 114. As an example, one end of the air flow pipe 130 may be inserted into the pipe connector 114.

The extension tube connector 110 may further include a first connector 116 that is to be connected to the grip part connector 150.

As an example, the first connector 116 may extend from the pipe connector 114 toward the grip part connector 150.

Here, when the extension tube connector 110 is rotated with respect to the air flow pipe 130 with reference to a central line C of the extension tube connector 110, the first connector 116 may extend in a parallel direction to an extension direction of the central line C of the extension tube connector 110 such that a rotational trajectory of the first connector 116 is minimized and a volume occupied by the first connector 116 is minimized. Although not illustrated, the central line C of the extension tube connector 110 may coincide with a central line of the extension tube 24.

Further, when the extension tube connector 110 is rotated with respect to the air flow pipe 130, the first connector 116 may be rounded such that the rotational trajectory of the first connector 116 is minimized. As an example, the first connector 116 may be formed to have an arc shape, and a center of the arc may coincide with the central line C of the extension tube connector 110.

A first fastening part 118 may be provided in the first connector 116, and the first fastening part 118 may surround a portion of the air flow pipe 130.

The air flow pipe 130 may communicate with the suction hose 23. That is, the air flow pipe 130 may include a pipe body 132 that defines a passage 133 for transferring the air and the dusts that are introduced from the extension tube connector 110, to the suction hose 23.

The suction hose 23 may be connected to the air flow pipe 130 directly or through a separate connection member. Further, the suction hose 23 may communicate with the air flow pipe 130 while being coupled to a pipe cover 170 which will be described below.

Here, a central line of the air flow pipe 130 may be a curved line. Thus, the air flow pipe 130 guides the air and the dusts that are introduced from the extension tube connector 110 to the suction hose 23 while a flow direction thereof is changed.

A rotation guide 134 may be provided in the air flow pipe 130. As an example, the grip part connector 150 may be rotatably connected to the rotation guide 134.

The rotation guide 134 may protrude from an outer surface of the pipe body 132.

In a state in which the air flow pipe 130 is connected to the extension tube connector 110, an extension direction of the rotation guide 134 may be parallel or identical to the extension direction of the central line C of the extension tube connector 110. As an example, the central line C of the extension tube connector 110 may pass through the rotation guide 134.

Here, an extension direction of a portion of the pipe body 132 intersects the extension direction of the rotation guide 134.

The rotation guide 134 may have a cylindrical shape and a portion thereof may be inserted into the grip part connector 150.

The first fastening part 118 may surround the rotation guide 134. Here, a rounded groove 119 may be formed in the first fastening part 118 such that an interference between the first fastening part 118 and the rotation guide 134 is prevented.

The grip part connector 150 may be formed integrally with or manufactured separately from the grip part 140 and may be connected to the grip part 140.

The grip part connector 150 may further include a second connector 154 that is to be connected to the first connector 116. A second fastening part 152 may be provided in the second connector 154. The second fastening part 152 may be fastened to the first fastening part 118 of the first connector 116 through a fastening member such as a screw and a hook.

The second fastening part 152 may have an accommodation part 162 in which a portion of the rotation guide 134 is accommodated. Further, an opening 160, through which a portion of an anti-separation part 164 for preventing the grip part connector 150 from being separated from the rotation guide 134 in a state in which the rotation guide 134 is accommodated in the accommodation part 162 passes, may be provided in the second fastening part 152.

Here, a portion of the anti-separation part 164 may have a diameter that is identical to or smaller than a diameter of the opening 160 and the other portion thereof may have a diameter that is larger than the diameter of the opening 160.

Further, the anti-separation part 164 and the rotation guide 134 may be fastened to each other through a fastening member 166 such as a screw.

Thus, according to the present embodiment, the grip part connector 150 may be presented from being separated from the rotation guide 134 in a state in which the anti-separation part 164 and the rotation guide 134 are fastened to each other through the fastening member 166, and the grip part connector 150 may be stably rotated by the rotation guide 134 as well.

Here, the central line C of the extension tube connector 110 may pass through the anti-separation part 164 and the second connector 154.

Thus, the grip part connector 150 may be rotated with respect to the central line C of the extension tube connector 110.

Further, the grip part 140 may be arranged such that the central line C of the extension tube connector 110 may pass through the grip part 140. Here, a center of rotation of the grip part 140 may be the central line C of the extension tube connector 110.

To achieve this, at least a portion of the second connector 154 of the grip part connector 150 may extend in parallel to at least a portion of the pipe body 132. Further, a third connector 156 that connects the second connector 154 and the grip part 140 to each other may be arranged in parallel to the extension tube connector 110. Further, the grip part 140 may be spaced apart from the second connector 154, may be located on a rear side of the second connector 154, and may extend upward from the third connector 156.

Thus, a space S in which a hand of the user may be located may be formed between the second connector 154 and the grip part 140. Further, the central line C of the extension tube connector 110 may pass through the space S.

Although not restrained, the grip part 140 and the grip part connector 150 may have a "U" shape.

By arrangement of the grip part 140 and the grip part connector 150, the central line C of the extension tube connector 110 may sequentially pass through the rotation guide 134 of the air flow pipe 130, the second connector 154 of the grip part connector 150, and the grip part 140. Further, the center of rotation of the grip part 140 may pass through the grip part 140.

The grip part 140 may include a manipulation part 142 through which various operation commands are input. As an example, the manipulation part 142 may be arranged above the grip part 140. The central line C of the extension tube connector 110 may be located between the manipulation part 142 and the third connector 156. As an example, on the basis of the central line C of the extension tube connector 110 that passes through the grip part 140, the third connector 156 may be located below the central line C and the manipulation part 142 may be located above the central line C of the extension tube connector 110.

The handle 100 may further include the pipe cover 170 for covering the air flow pipe 130.

The pipe cover 170 may additionally cover the first connector 116 of the extension tube connector 110 and a portion of the second connector 154 of the grip part connector 150. That is, the entire first connector 116 and the portion of the second connector 154 that connect the extension tube connector 110 and the grip part connector 150 to each other may be located inside the pipe cover 170.

The pipe cover 170 may be completely formed by coupling a plurality of members. Although not restricted, the pipe cover 170 may include a first pipe cover 171, a second pipe cover 172 and a third pipe cover 173. The first pipe cover 171 and the second pipe cover 172 may be coupled to each other in a horizontal direction, and the third pipe cover 173 connects the first pipe cover 171 and the second pipe cover 172 to each other. Further, the third cover 173 may cover an outside of the first connector 116. That is, the first connector 116 may be located between the third pipe cover 173 and the air flow pipe 130.

Further, the first to third covers 171 to 173 may be fastened to each other through a connector ring 180.

Here, because the third pipe cover 173 covers the first connector 116, the third pipe cover 173 may be formed to have an arc shape having the central line C of the extension tube connector 110 as a center and may be formed to have a radius that is larger than a radius of the first connector 116, such that the third pipe cover 173 is prevented from being interfered by the first connector 116 while the first connector 116 is rotated.

According to the present embodiment, the pipe cover 170 may cover the air flow pipe 130 and the third connector 116 and may guide rotation of the extension tube connector 110 when the extension tube connector 110 is rotated as well.

According to the present embodiment, as the central line C of the extension tube connector 110 passes through the grip part 140, the first connector 116 may extend in a parallel direction to the extension direction of the central line C of the extension tube connector 110, so that the first connector 116 may be accommodated in the pipe cover 170.

Further, as the first connector 116 is located in the pipe cover 170, the entire volume of the handle 100 may be reduced, and the grip part connector 150 and the extension tube connector 110 may be rotated together with the grip part 140 even while the extension tube connector 110, the pipe cover 170 and the grip part connector 150 may have a sense of unity.

Figure 6:
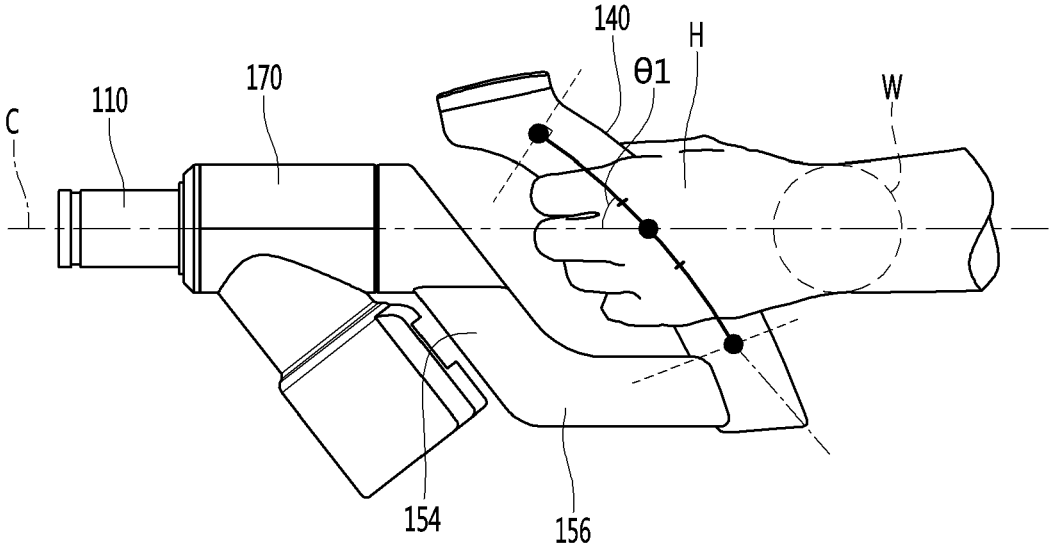
FIG. 6 is a view illustrating a state in which a hand of a user holds a grip part.
Figure 7:
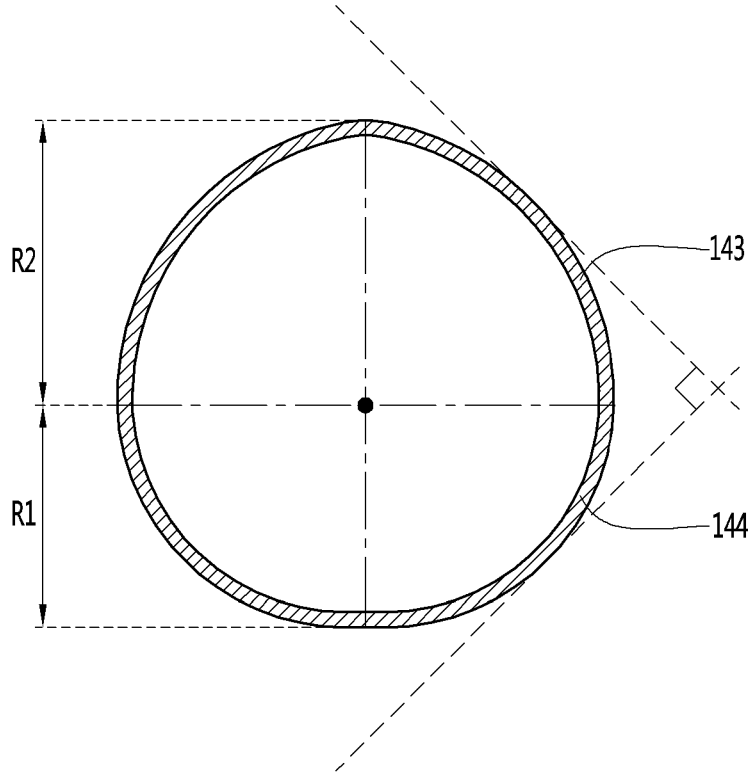
FIG. 7 is a sectional view taken along line A-A of FIG. 2.
Figure 8:
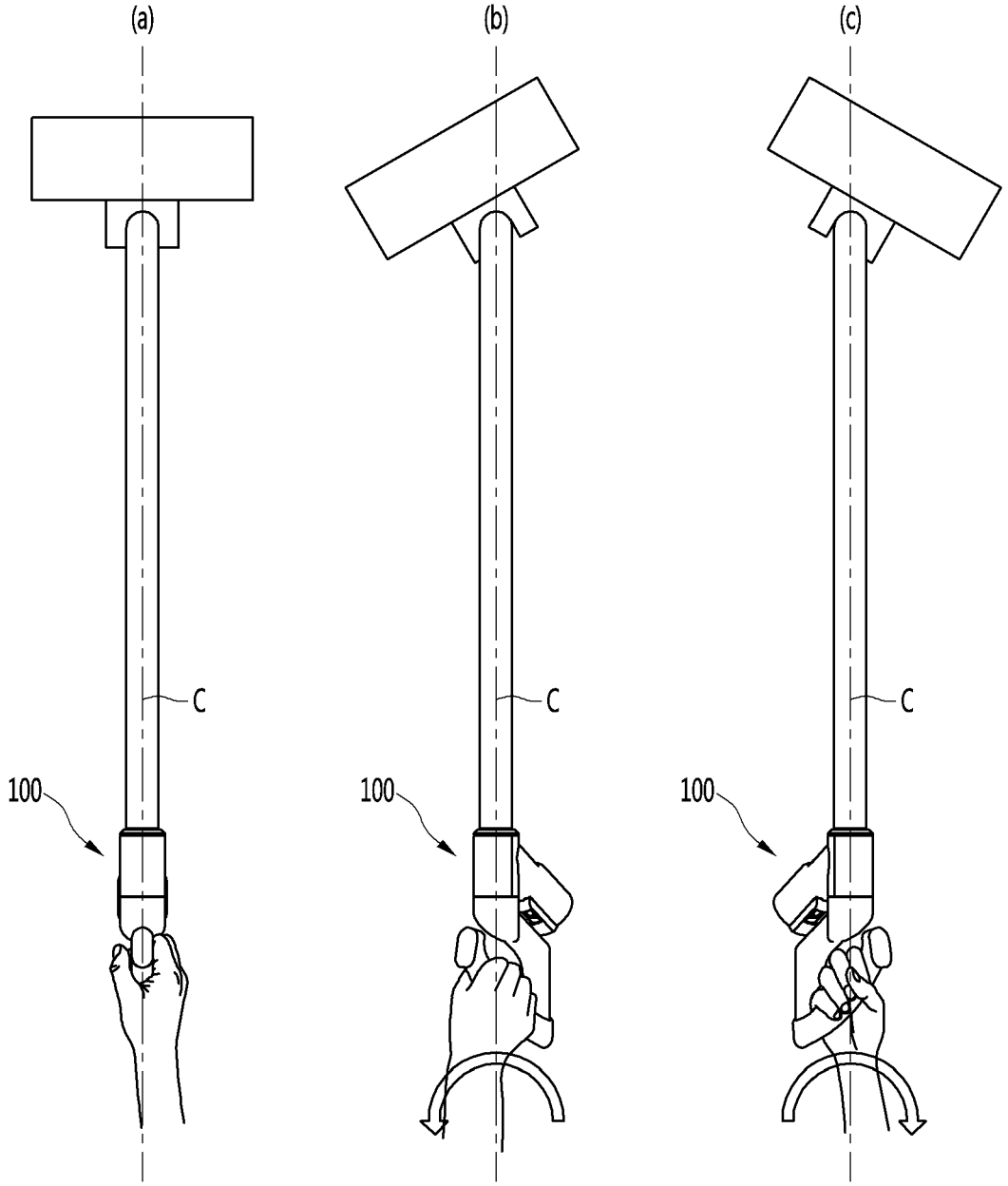
FIG. 8 is a view illustrating a state in which a user rotates a grip part leftward or rightward while a hand of the user holds the grip part.

FIG. 6 is a view illustrating a state in which the hand of the user holds the grip part, FIG. 7 is a sectional view taken along line A-A of FIG. 2, and FIG. 8 is a view illustrating a state in which the grip part is rotated leftward or rightward while the hand of the user holds the grip part.

Referring to FIGS. 5 to 8, the central line C of the extension tube connector 110 may pass through the grip part 140. As well, in a state in which the hand H of the user holds the grip part 140, the central line C of the extension tube connector 110 may pass through the hand H and a wrist W of the user.

Thus, as illustrated in FIG. 8, when the user wants to rotate the grip part 140 leftward or rightward while holding the grip part 140, a rotational force of the grip part 140 may be generated by the wrist W of the user.

As in the present disclosure, when the central line C of the extension tube connector 110 passes through the wrist W of the user, the grip part 140 may be rotated with respect to the central line C of the extension tube connector 110, so that a rotational path of the grip part 140 is short.

Thus, according to the present disclosure, as the wrist W is rotated with respect to the central line C of the extension tube connector 110 in a state in which the wrist W of the user is not bent, the grip part 140 may be rotated, and the rotational force of the grip part 140 may be transferred to the extension tube connector 110. Thus, the grip part 140 may be rotated without a burden of the wrist W of the user.

When the rotational force of the grip part 140 is transferred to the extension tube connector 110, the rotation force of the grip part 140 is transferred to the suction part 21 through the extension tube 24, and the suction part 21 may be finally pivoted leftward or rightward.

When the central line C of the extension tube connector 110 does not pass through the wrist W of the user, it may be easily predicted that the wrist W of the user should be bent to rotate the grip part 140.

In the present embodiment, when the central line C of the extension tube connector 110 is divided into three areas in a lengthwise direction of the grip part 140 such that the central line C of the extension tube connector 110 passes through the wrist W of the user, the grip part 140 may be arranged to pass through a central portion of the three areas.

When the central line C of the extension tube connector 110 passes through the central portion of the grip part 140, the extension direction of the central line C of the extension tube connector 110 may be arranged substantially parallel to an extension direction of an arm of the user in a state in which the arm of the user is unfolded.

Thus, in this state, a force of the user, which is required to push or pull the handle 100 by the user, may be minimized, and bending of the wrist may be prevented.

Further, an angle θ1 between the central line C of the extension tube connector 110 and the grip part 140 may be approximately 45 degrees to 50 degrees.

In this case, when the suction part 21 is moved forward/rearward in a state in which the suction part 21 is located on a bottom surface and the user holds the grip part 140, the bending of the wrist of the user may be minimized.

As well, even when the suction part 21 is moved in a state in which the suction part 21 is spaced apart from the bottom surface and the user then holds the grip part 140, the bending of the wrist of the user may be minimized.

Further, the third connector 156 connects a lower side of the second connector 154 and a lower side of the grip part 140 to each other to support the hand of the user in a state in which the hand of the user holds the grip part 140.

Thus, while the grip part 140 is pulled in a state in which the grip part 140 is held, the grip part 140 may be prevented from being missed by the hand of the user. That is, because the hand of the user is caught by the third connector 156 when the grip part 140 is pulled by the hand, the grip part 140 may be prevented from being missed by the hand.

Meanwhile, referring to FIG. 7, although not restrained, the grip part 140 may include a first rounded grip body 143 and a second rounded grip body 144 that has a different curvature from that of the first grip body 143, as a portion that is adjacent to the first connector 154.

Here, in a state in which the user holds the grip part 140, fingers of the user are in contact with the first grip body 143 and a palm of the user is in contact with the second grip body 144.

A radius R2 of the first grip body 143 may be formed larger than a radius R1 of the second grip body 144 such that the grip part 140 may be prevented from being missed by the hand that holds the grip part 140.

Further, the radius of the curvature of the first grip body 143 may be formed larger than the radius of the curvature of the second grip body 144.

Although not restrained, a tangent line of the first grip body 143 may be substantially perpendicular to a tangent line of the second grip body 144.

Thus, there are advantages in that a probability the fingers that are in contact with the first grip body 143 miss the first grip body 143 may be minimized, and the palm that is in contact with the second grip body 144 may stably support the second grip body 144.

Figure 9:
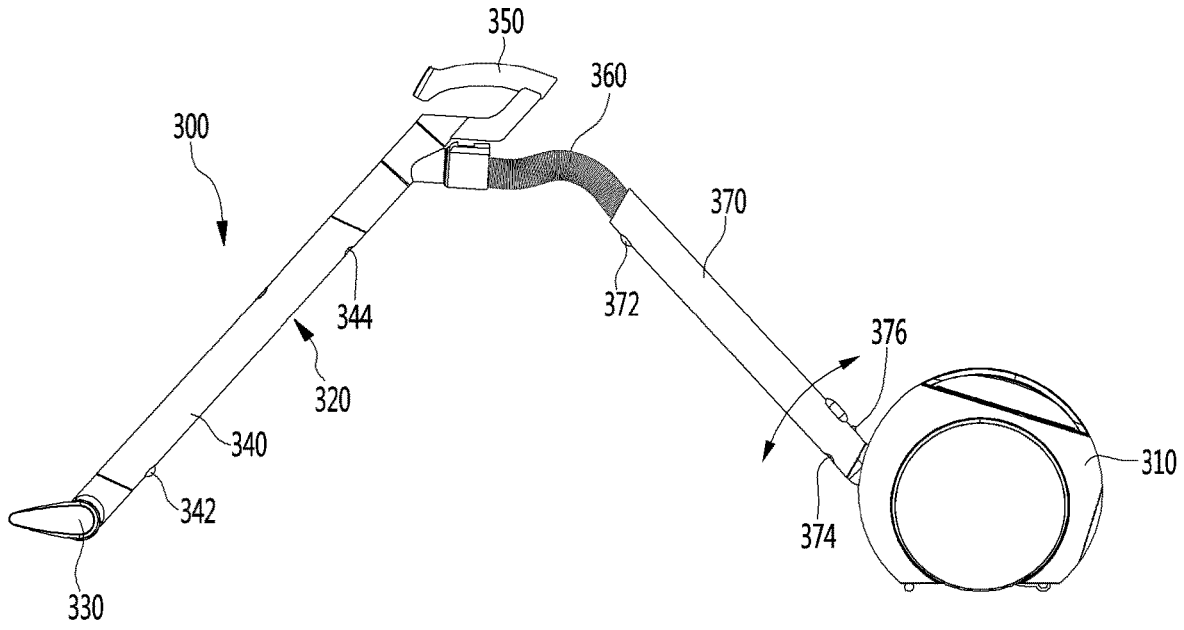
FIGS. 9 and 10 are perspective views illustrating a vacuum cleaner according to a second embodiment of the present disclosure.
Figure 10:
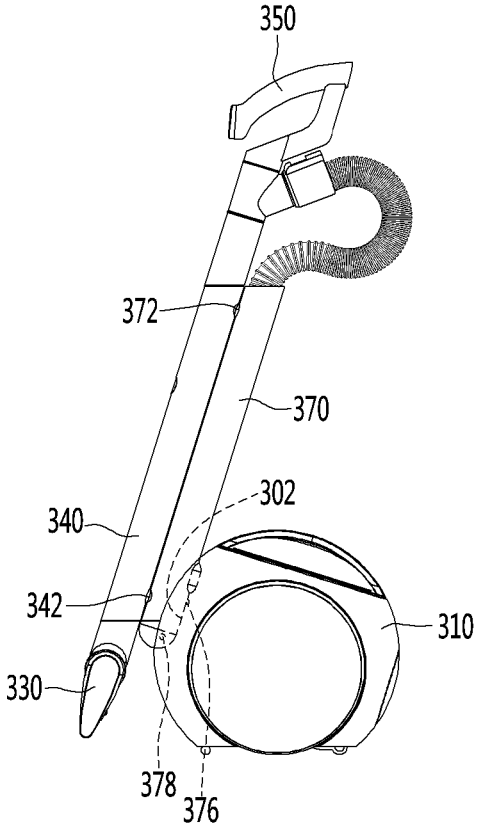

FIGS. 9 and 10 are perspective views illustrating a vacuum cleaner according to a second embodiment of the present disclosure, FIG. 9 illustrates a state in which a relative location between an extension tube and a cleaner body is fixed to each other for storing a vacuum cleaner, and FIG. 10 illustrates a state in which the extension tube and the cleaner body is unfixed.

In the present embodiment, other elements are identical to those according to the first embodiment, but only a structure for storing the suction device is different from that according to the first embodiment. Thus, only characteristic parts according to the present embodiment will be described below.

Referring to FIGS. 9 and 10, a vacuum cleaner 300 according to a second embodiment of the present disclosure may include a cleaner body 310 and a suction device 320 that is connected to the cleaner body 310.

The suction device 320 may include a suction part 330 for sucking dusts on a surface to be cleaned, for example, a bottom surface, and connection parts 340, 350, 360 and 370 for connecting the suction part 330 to the cleaner body 310.

The connection parts 340, 350, 360 and 370 may include a first extension tube 340 that is connected to the suction part 330, a handle 350 that is connected to the extension tube 340, a suction hose 360 that is connected to the handle 350, and a second extension tube 370 that connects the suction hose 360 and the cleaner body 310 to each other.

In the present embodiment, because a structure and an operation of the handle 350 are identical to those described in the first embodiment, detailed descriptions thereof will be omitted.

The first extension tube 340 may be rotatably connected to the suction part 330. Further, the second extension tube 370 may be rotatably connected to the cleaner body 310 through a hinge 378.

Thus, although not illustrated, a connection hose that is formed of plastic and is connected to the second extension tube 370 may be provided in the cleaner body 310 such that air and dusts are guided to the cleaner body 310 while the second extension tube 370 is rotated with respect to the cleaner body 310.

At least a portion of each of the first extension tube 340 and the second extension tube 370 may be formed of metal.

The suction device 320 may further include a first fixing mechanism for fixing locations of the first extension tube 340 and the second extension tube 370 in a state in which they are in contact with each other.

The first fixing mechanism may include magnets 342 and 372 that are provided in one or more of the first extension tube 340 and the second extension tube 370.

Here, the magnets 342 and 372 or portions where the magnets 342 and 372 are located may protrude from the first extension tube 340 and the second extension tube 370, respectively, and grooves 344 and 374 in which the magnets 342 and 372 or the portions where the magnets 342 and 372 are located are accommodated may be provided in one or more of the first extension tube 340 and the second extension tube 370, such that a relative rotation between the first extension tube 340 and the second extension tube 370 is prevented in a state in which the first extension tube 340 and the second extension tube 370 are in contact with each other by the magnets 342 and 372.

Further, the first extension tube 340 and the second extension tube 370 may be fixed to each other by the plurality of magnets 342 and 372 such that the first extension tube 340 is prevented from being slid in a lengthwise direction of the first extension tube 340 by a self-weight thereof in a state in which the first extension tube 340 and the second extension tube 370 are in contact with each other.

Here, the plurality of magnets 342 and 372 may be spaced apart from each other a lengthwise direction of the first extension tube 340 or the second extension tube 370.

As an example, FIG. 9 illustrates a state in which the first magnet 342 and the first groove 344 are provided in the first extension tube 340 and the second magnet 372 that is accommodated in the first groove 344 and the second groove 374 in which the first magnet 342 is accommodated are provided in the second extension tube 370. However, unlike this, the plurality of magnets 342 and 372 are provided in any one of the first extension tube 340 and the second extension tube 370 and the plurality of grooves 344 and 374 are provided in the other one of the first extension tube 340 and the second extension tube 370.

Further, in a state in which the first extension tube 340 is fixed to the second extension tube 370, the two extension tubes are parallel to each other.

Meanwhile, as illustrated in FIG. 10, the second extension tube 370 may be fixed to the cleaner body 310 in an uprightly standing state.

The vacuum cleaner 300 may further include a second fixing mechanism for fixing the second extension tube 370 to the cleaner body 310.

The second fixing mechanism may include a magnet 376 that is provided in one or more of the second extension tube 370 and the cleaner body 310. That is, a portion of the second fixing mechanism, which is spaced apart from the hinge 378 of the second extension tube 370, may be fixed to the cleaner body 310 through the magnet 376.

A support groove 302 through which the second extension tube 370 is stably supported may be provided in the cleaner body 310.

Here, an angle that is formed between an extension line and a bottom surface of the second extension tube 370 in a state in which the second extension tube 370 is seated on the support groove 302 and is fixed to the cleaner body 310 such that a contact area of the second extension tube 370 and the support groove 302 is increased may be lower than 90 degrees. However, an angle that is formed between the extension line and the bottom surface of the second extension tube 370 to store the second extension tube 370 in a standing state may be 60 degrees or higher. Further, at least a portion of the handle 350 may vertically overlap the cleaner body 10 such that a space that is occupied by the second extension tube 340 is reduced in a state in which the second extension tube 340 is fixed to the cleaner body 10 in a standing state.

According to the present disclosure, because the first extension tube 340 is fixed to the second extension tube 370 in a state in which the second extension tube 370 is fixed to the cleaner body 310 in a standing state and the first extension tube 340 is in contact with the second extension tube 370, a space for storing the vacuum cleaner 300 is reduced, and thus the vacuum cleaner 300 is easily stored.

Further, because the two extension tubes are connected to the handle and the suction hose, a length of the suction hose may be reduced, so that the suction hose may be prevented from being moved in an intended direction when the vacuum cleaner is used or stored.

The invention claimed is:

1. A handle for a cleaner, the handle comprising:

an extension tube connector that is connected to an extension tube along a central line;

an air flow pipe that is connected to both the extension tube connector and a suction hose that fluidically communicates with the extension tube connector to transfer air and dusts from the extension tube to the suction hose;

a grip part that is to be held by a user;

a grip part connector that rotatably connects the extension tube connector and the grip part to each other such that the extension tube connector rotates relative to the grip part about the central line, wherein the grip part is arranged such that the central line passes through the grip part, and wherein the air flow pipe comprises:

a pipe body that defines an air passage, and a rotation guide that protrudes from an outer surface of the pipe body toward the grip part and that rotatably connects to the grip part connector such that the air flow pipe rotates relative to the grip part about the central line.

2. The handle of claim 1, wherein the air flow pipe is rotatably connected to the extension tube connector such that the air flow pipe rotates relative to the extension tube connector about the central line.

3. The handle of claim 1, wherein an extension direction of a portion of the pipe body intersects an extension direction of the rotation guide.

4. The handle of claim 1, wherein the extension tube connector comprises a first connector that extends in parallel to the central line of the extension tube connector, wherein the grip part connector comprises a second connector that is fastened to the first connector, and wherein the central line of the extension tube connector passes through the second connector.

5. The handle of claim 4, wherein the first connector comprises a first fastening part that surrounds the rotation guide, and wherein the second connector comprises a second fastening part that is fastened to the first fastening part and that accommodates a portion of the rotation guide.

6. The handle of claim 5, further comprising:

an anti-separation part that prevents the rotation guide and the second fastening part from being separated from each other, and a fastening member that fastens the anti-separation part and the rotation guide to each other.

7. The handle of claim 4, wherein the grip part connector further comprises a third connector that connects the second connector and the grip part to each other, and wherein the grip part is located on a rear side of the second connector and spaced apart from the second connector such that a space in which a hand of the user is located is formed between the grip part and the second connector.

8. The handle of claim 7, wherein at least a portion of the second connector extends in a parallel direction to an extension direction of a portion of the pipe body, and wherein at least a portion of the third connector extends parallel to the central line of the extension tube connector.

9. The handle of claim 7, wherein the grip part comprises a manipulation part for manipulation of the user, and wherein the central line of the extension tube connector passes between the manipulation part and the third connector.

10. The handle of claim 7, wherein the second connector, the third connector, and the grip part are arranged to have a "U" shape.

11. The handle of claim 4, further comprising a pipe cover that covers the air flow pipe, wherein the first connector is located inside the pipe cover.

12. The handle of claim 11, wherein the first connector is formed to have an arc shape having the central line of the extension tube connector as a center, and wherein a portion of the pipe cover is formed to have an arc shape having the central line of the extension tube connector as a center, and has a radius that is larger than a radius of the first connector.

13. The handle of claim 4, wherein the grip part comprises:

a first grip body that is rounded to be adjacent to the first connector, and a second grip body that is rounded such that a curvature of the second grip body is different from a curvature of the first grip body.

14. The handle of claim 13, wherein a radius of the first grip body is larger than a radius of the second grip body, or a radius of the curvature of the first grip body is larger than a radius of the curvature of the second grip body.

15. The handle of claim 13, wherein a tangent line of the first grip body is perpendicular to a tangent line of the second grip body.

* * * * *